United States Patent [19]

Onoda et al.

[11] 4,424,856

[45] Jan. 10, 1984

[54] ELECTROMAGNETIC STIRRING UNIT FOR CONTINUOUS STEEL CASTING MOULD

[75] Inventors: Susumu Onoda, Yawatahigashi; Haruo Kitamura; Toshio Kikuchi, both of Kitakyushu, all of Japan

[73] Assignee: Nippon Steel Corporation, Tokyo, Japan

[21] Appl. No.: 235,881

[22] Filed: Feb. 19, 1981

[30] Foreign Application Priority Data

Feb. 23, 1980 [JP] Japan ..... 55-22647[U]
Feb. 23, 1980 [JP] Japan ..... 55-22648[U]

[51] Int. Cl.[3] ..... B22D 11/10
[52] U.S. Cl. ..... 164/504
[58] Field of Search ..... 164/468, 504, 507, 513, 164/493

[56] References Cited

U.S. PATENT DOCUMENTS 4,040,467 8/1977 Alberny ..... 164/504
4,150,712 4/1979 Dussart ..... 164/504
4,200,141 4/1980 Delassus ..... 164/504

*Primary Examiner*—Gus T. Hampilos
*Assistant Examiner*—Richard K. Seidel
*Attorney, Agent, or Firm*—Pollock, Vande Sande & Priddy

[57] ABSTRACT

An improved electromagnetic stirring unit is disclosed for use in continuous casting of steel in which the cooling unit which houses the electromagnetic stirring coil (6) comprises a cooling wall (9) for a direct contact with the molten steel (12), the cooling wall having at its inner side a plurality of cooling water passages (10,11) for evenly distributing the cooling water, a chamber (2) for housing the electromagnetic stirring coil disposed such that the upper end of the electromagnetic stirring coil is at the level of the molten steel surface in the casting mould; a water discharge chamber (4); and a water supply chamber (3) a side wall (7) of the coil housing chamber, opposite to the cooling wall, having an opening large enough to permit the electromagnetic stirring coil to pass therethrough; the electromagnetic stirring coil being attached to a readily removable cover (7') for this opening, whereby preventive maintenance of the coil is facilitated, FIG. 2.

2 Claims, 7 Drawing Figures

ELECTROMAGNETIC STIRRING UNIT FOR CONTINUOUS STEEL CASTING MOULD

BACKGROUND OF THE INVENTION

The present invention relates to continuous casting of steels and, more particularly, to an electromagnetic stirring unit for continuous casting of steels, having an electromagnetic stirring coil for floating non-metallic impurities and gases entrapped in the molten steel by electromagnetically stirring the molten steel in a mould to remove these impurities and gases.

Still more particularly, the invention is concerned with an electromagnetic stirring unit for a continuous steel casting mould, the unit constituting at least a part of the side wall of the mould.

The invention is also concerned with an electromagnetic stirring unit of the type mentioned above, in which the electromagnetic stirring coil is enclosed within a housing constructed to permit an easy mounting and dismounting of the electromagnetic stirring coil.

It is known to electromagnetically stir the molten steel in a mould so as to positively float and remove non-metallic impurities and gases contained therein to improve the surface quality of the cast strand. For instance, Japanese Patent Application No. 4241/1979 discloses a casting mold having means for effecting such electromagnetic stirring. FIG. 1 of the present application shows a conventional continuous steel casting mould equipped with an electromagnetic stirring means. In this known casting mould, an electromagnetic stirring coil 6' is disposed to extend over the entire length and height of at least one of the walls of the mould, as will be seen from FIG. 1. Cooling water is supplied from a water supply chamber 3' provided at a lower part of a casting mould cooling box 1' so as to flow upwards through the passages in the mould wall directly contacting the molten steel, and is discharged through a water discharge chamber 4' provided at the upper end of the cooling box 1'.

As disclosed by the present inventors in the specification of Japanese Patent Laid-open Application No. 64953/1980, it is desired to position the top end of the stirring coil as close as possible to the liquid steel level (meniscus) in the mould, in order to obtain cast strands having a superior surface quality.

On the other hand, the rate of operation of the mould having electromagnetic stirring means is lowered by various reasons such as the necessity for the inspection, maintenance and replacement of the parts of the electromagnetic stirring unit, besides the wear of the cooling wall of the mould which is usually made of copper plate due to its high heat conductivity.

In the conventional mould shown in Japanese Patent Application No. 4241/1979, as shown in FIG. 1, the mould wall 9' is attached to the mould side wall 7'' opposite to the molten steel by means of a multiplicity of bolts 5' to form the water supply chamber, water discharge chamber and a chamber 2' for housing the electromagnetic coil. Therefore, even when the inspection or maintenance work is to be made solely for the electromagnetic stirring coil, it is necessary to remove all of the multiplicity of bolts 5' which are driven from the outside of the cooling box 1 into the mould cooling wall 9' across the chamber 2' housing the electromagnetic stirring coil. In addition, this work accompanies various troublesome tasks such as detaching and attaching of packing between the cooling box 1' and the mould cooling wall 9', packing between the cooling box 1' and the water supplying and discharge chambers 3', 4' as well as connecting and disconnecting of the water pipes. Thus, it is necessary to disassemble the entirety of the mould, solely for the purpose of inspection or maintenance of the electromagnetic stirring coil. Clearly, these troublesome tasks impractically lower the rate of operation of a continuous casting process using the mould.

SUMMARY OF THE INVENTION

Accordingly, an object of the present invention is to provide an electromagnetic stirring unit for continuous steel casting, in which the top end surface of the coil is positioned at liquid molten steel in the mould or positioned as close as possible to the liquid steel level, thereby to ensure a high stirring effect.

Another object of the invention is to provide a casting mould equipped with an electromagnetic stirring unit, which is designed and constructed to permit an easy inspection, maintenance, replacement and other tasks conducted solely for the electromagnetic stirring unit, thereby to eliminate the above-described problems of the prior art which requires considerable time and labour for the inspection, maintenance and so forth of the electromagnetic stirring unit.

To these ends, according to the invention, the discharge chamber for discharging the mould cooling water, which is usually provided, as a well known practice, at an upper part of the mould, is disposed at the lower part of the chamber for housing the electromagnetic stirring unit. This construction is realized by a specific arrangement of the passage for cooling water.

The present invention provides, to achieve the above-mentioned another object of the invention, a mould in which an opening of a size large enough to permit the electromagnetic stirring coil to pass therethrough is formed in the rear wall (wall opposite to the molten steel) of the chamber for housing the electromagnetic stirring coil, and a lid for mounting the electromagnetic stirring coil is detachably attached to the rear wall to close the opening.

These and other objects, as well as advantageous feature of the invention will become clear from the following description of the preferred embodiment of the invention taken in conjunction with the accompanying drawings.

DETAILED DESCRIPTION OF THE INVENTION

Figure 1:
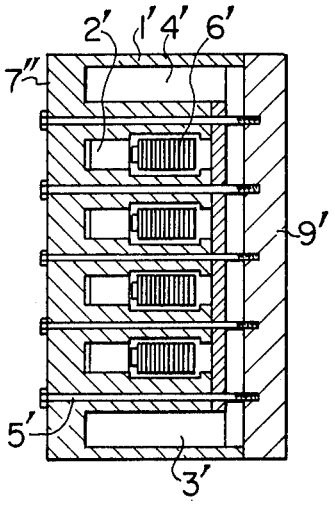
FIG. 1 PRIOR ART
FIG. 1 is a schematic illustration of a conventional electromagnetic stirring unit for a continuous steel casting mould.
Figure 2:
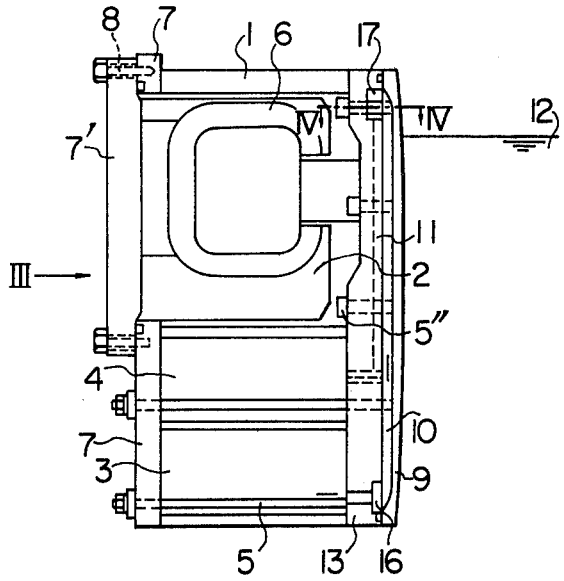
FIG. 2 is a sectional side elevational view of an electromagnetic stirring unit for continuous steel casting mould, incorporating an electromagnetic stirring coil.
Figure 4:
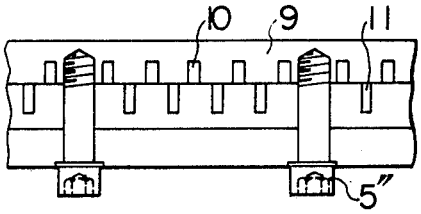
FIG. 4 is a partly sectioned plan view as viewed along the line IV—IV of FIG. 2.
Figure 3:
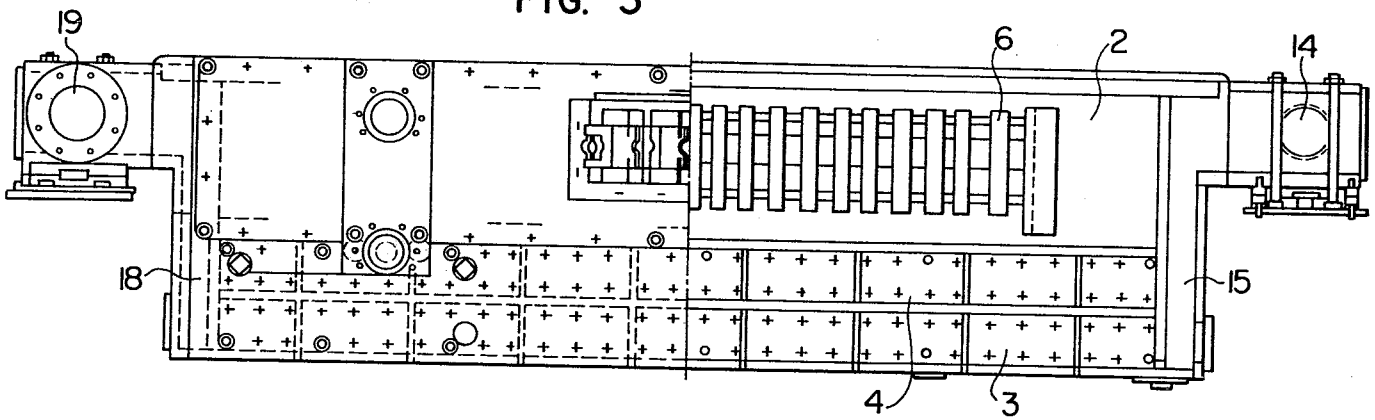
FIG. 3 is a front elevational view of an electromagnetic stirring unit in accordance with the present invention, as viewed in the direction of arrow III of FIG. 2, with the longitudinal half part (lower half part on plane of FIG. 3) being shown in section.

Referring to FIGS. 2 and 3, a cooling wall 9 for directly contacting the molten steel is attached to the surface of the mould cooling box 1 adjacent to the molten steel. The cooling box 1 is also provided with a water supply chamber 3 for supplying cooling water to cooling water passages 10 formed in the cooling wall 9, a water discharge chamber 4 through which the cooling water coming from the passages 10 is discharged and a chamber 2 for housing an electromagnetic stirring coil 6.

More specifically, as will be seen from the drawings, the cooling box 1 is provided at its upper portion with the chamber 2 for accomodating the electromagnetic stirring coil and, at its lower portion, with the water supply chamber 3 and the water discharge chamber 4. A front plate 13 is provided with water discharge passage 11 through which the cooling water discharges after having cooled the cooling wall 9.

To explain the cooling system in more detail FIG. 3 shows that the cooling water for cooling the mould is charged through a water inlet port 14 and is passed to the water supply chamber 3 through a water supply box 15. The cooling water is then distributed evenly toward the cooling wall 9 by way of a water supply header 16 provided in the front wall 13. The water then flows upward along the water passages 10, while effectively cooling the molten steel 12 in the mould through a heat exchange across the cooling wall 9, and flows into the water discharge chamber 4 through a water discharge header 17 and the water discharge passages 11. The cooling water is finally discharged to an outlet port 19 via a water discharge box 18.

Referring to FIG. 2, a reference numeral 5″ denotes bolts by which the cooling wall 9 contacting the molten steel is secured to the front wall 13, while a numeral 5 designates bolts which connect the cooling wall to the rear wall 7.

A mounting plate 7′ for mounting the electromagnetic stirring coil plays also the role of a lid for closing a later-mentioned opening formed in the wall of the chamber 2 for housing the electromagnetic stirring coil.

Figure 6A:
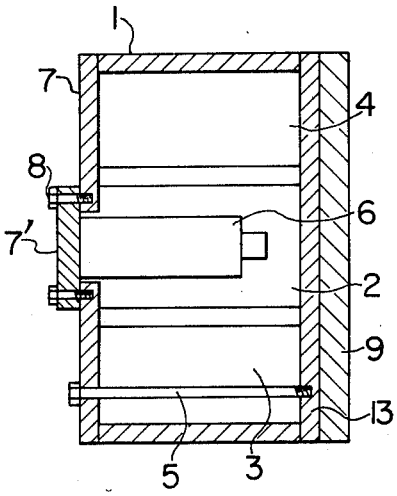
FIG. 6A is a side elevational view of an embodiment in which the chamber for housing the electromagnetic stirring unit is disposed at the central portion of the mould cooling box.
Figure 6B:
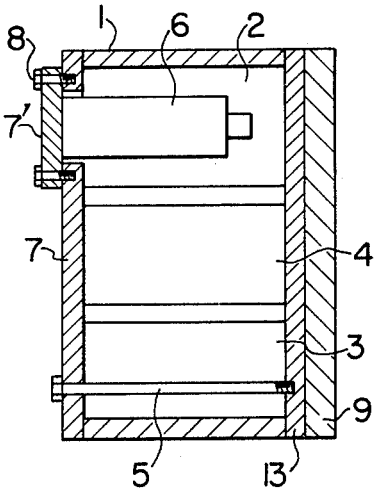
FIG. 6B is a side elevational view of another embodiment in which the electromagnetic stirring unit is disposed at an upper part of the cooling box.

The construction shown in FIG. 2, in which the chamber 2 for housing the electromagnetic stirring coil is disposed at the upper part of the cooling box, corresponds to the arrangement shown in FIG. 6B. This arrangement, however, is not exclusive, and it is possible to locate the chamber 2 at the central portion of the mould cooling box 1, as shown in FIG. 6A.

According to the invention, as will be seen from FIGS. 2, 3, 6A and 6B, an opening of a size large enough to permit the electromagnetic coil 6 to pass therethrough is formed at a portion of the wall 7 of cooling box 1 opposite to the molten steel, and the mounting plate 7′ of the coil housing chamber 2 opposite to the molten steel is constructed to function also as the lid for closing the above-mentioned opening. This mounting plate 7′ is secured to the above-mentioned rear wall 7 of the cooling box detachably by means of bolts 8. The electromagnetic stirring coil 6 is attached to the mounting plate 7′ functioning also as a lid.

Figure 5:
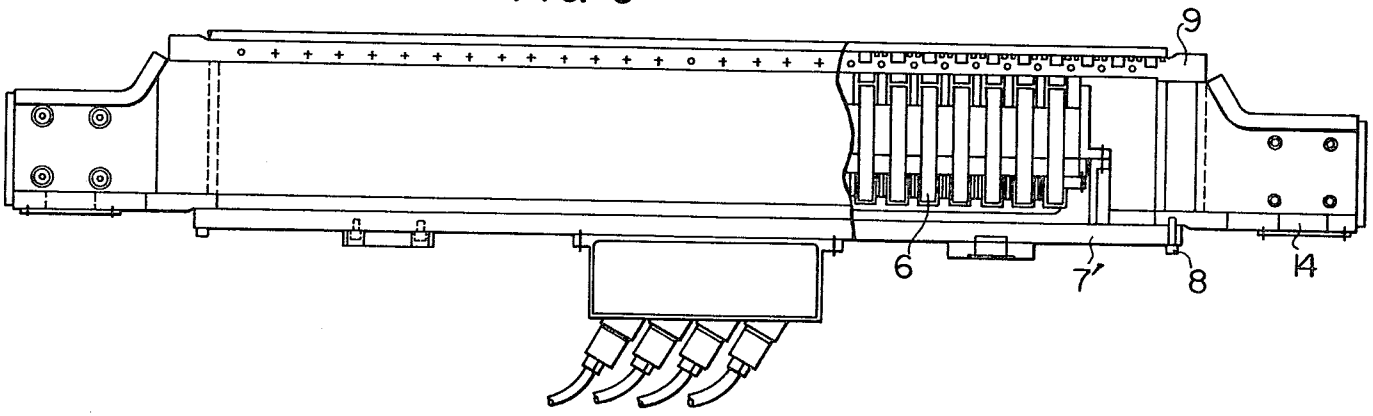
FIG. 5 is a plan view with a part being removed, showing the internal structure at a reduced scale.

In FIGS. 2, 3 and 5, the electromagnetic stirring unit of the invention is shown constituing one of the walls of the continuous steel casting mould. Depending on the cross-sectional shape and the size of the mould, the electromagnetic stirring unit of the invention may constitute at least one of the walls of the mould. In the case where the casting mould has a rectangular cross-section, the electromagnetic stirring unit is constructed to constitute one or both of the opposing wide face walls, while, when the mould has a square cross section, the electromagnetic stirring unit can constitute one or both of opposing walls or even all of the four walls.

As has been described, according to the present invention, the water discharge passages 11 for discharging the cooling water after cooling the casting mould are formed in the front wall of the cooling box at the side of the latter adjacent to the molten steel. It is, therefore, possible to dispose the cooling water discharge chamber 4 at the lower part of the casting mould, to permit the mounting of the electromagnetic stirring unit at the upper part of the mould. Consequently, it becomes possible to position the upper end surface of the electromagnetic stirring coil at the same level as the liquid steel in the mould to ensure a good stirring effect and, hence, a good surface quality of the cast strand.

According to the invention, the chamber 2 for housing the electromagnetic stirring unit is formed separately from the mould cooling water supply and discharge chambers, so that it is possible to use different supplies of cooling water for separately cooling the stirring unit and for cooling the mould, respectively. Namely, it is possible to use cooling water having high purity for cooling the electromagnetic stirring unit at such a low pressure as not to break the insulation of the electromagnetic stirring unit, while using, for cooling the wall of the mould, cooling water of a sufficiently high pressure of, for example, 10 kg/cm$^2$. This arrangement is advantageous in that the demand for the pressure resistance of the electromagnetic stirring unit is reduced to lower the production costs and running costs.

It is to be noted that, as will be understood from FIGS. 2, 5, 6A and 6B, the electromagnetic stirring coil 6 can be withdrawn from the chamber 2 together with the inner support plate 7′ functioning as the lid, simply by detaching the latter. It is, therefore, possible to mount and dismount the electromagnetic stirring coil 6 together with the lid 7′ for the purpose of inspection, maintenance, replacement or the like, simply by removing the bolts 8, without interferring with the cooling water system. Thus, various tasks for preventive maintenance are easily facilitated and troubles concerning electric insulation due to collision of coil or core are avoided advantageously.

What is claimed is:

1. In an electromagnetic stirring unit for a continuous steel casting mould of the type including a cooling wall constituting one or more of the walls of said casting mould for direct contact with molten steel at the outer side of said cooling wall, said cooling wall having cooling water passages at the inner side thereof; an electromagnetic stirring coil for electromagnetically stirring said molten steel; and a cooling box having therein a chamber for housing said electromagnetic stirring coil, a water supply chamber for supplying said cooling water passages with cooling water and a water discharge chamber through which said cooling water is discharged, said cooling box being connected to said inner side of said cooling wall to constitute said unit, the improvement comprising said chamber for housing said electromagnetic stirring coil being disposed at an upper part of said cooling box; said water discharge chamber being disposed under said chamber for housing said electromagnetic stirring coil; said water supply chamber being disposed under said water discharge chamber; a water discharge header communicating with said cooling water passages; and water discharge passages communicating at one end with said discharge header and at the other end with said discharge chamber, said discharge passages being formed in a front wall of said cooling box which contacts said inner side of said cooling wall.

2. An electromagnetic stirring unit for a continuous steel casting mould as claimed in claim 1, wherein said cooling box comprises a rear wall of said chamber for housing said electromagnetic stirring coil, said rear wall having an opening of a size large enough to permit said electromagnetic stirring coil to pass therethrough, said opening being opposite to said molten steel; further comprising a mounting plate, said electromagnetic stirring coil being attached to said mounting plate and said mounting plate being configured for closing said opening and means for detachably securing said mounting plate to said rear wall, whereby said electromagnetic stirring coil can be mounted into and dismounted from its chamber, as a unit integral with said mounting plate.

* * * * *